US010570698B2

(12) United States Patent
Peyregne et al.

(10) Patent No.: US 10,570,698 B2
(45) Date of Patent: Feb. 25, 2020

(54) INTEGRATED REMOTE CHOKE SYSTEM CONTROL ARCHITECTURE

(71) Applicant: Nabors Drilling Technologies USA, Inc., Houston, TX (US)

(72) Inventors: Joey Peyregne, Spring, TX (US); Adam Keith, Spring, TX (US); Scott Boone, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 207 days.

(21) Appl. No.: 15/475,055

(22) Filed: Mar. 30, 2017

(65) Prior Publication Data

US 2018/0283138 A1 Oct. 4, 2018

(51) Int. Cl.

| | |
|---|---|
| ***E21B 21/08*** | (2006.01) |
| ***E21B 34/16*** | (2006.01) |
| ***E21B 33/06*** | (2006.01) |

(52) U.S. Cl.

CPC ..... *E21B 34/16* (2013.01)

(58) Field of Classification Search

CPC ..... E21B 21/08; E21B 34/16; E21B 33/06; E21B 34/02

See application file for complete search history.

(56) References Cited

U.S. PATENT DOCUMENTS

2005/0222772 A1* 10/2005 Koederitz ..... E21B 21/08 702/6

* cited by examiner

*Primary Examiner* — Catherine Loikith

(57) ABSTRACT

A technology is described for controlling an electric choke actuator included in a drilling rig. An example system can include a computing device configured to provide position data for an electric choke actuator configured to control a well choke valve in selective fluid communication with a blow-out preventer arranged to close a borehole. The system can receive a choke position command to move the electric choke actuator from a first position to a second position, whereupon a control signal can be sent to the electric choke actuator that causes the electric choke actuator to move from the first position to the second position. Position data for the electric choke actuator can be updated to indicate the second position.

19 Claims, 9 Drawing Sheets

INTEGRATED REMOTE CHOKE SYSTEM CONTROL ARCHITECTURE

BACKGROUND

Various ground drilling operations are known, such as exploring and/or extracting oil and other natural resources from subterranean deposits. Typically, a drilling operation is conducted on a drill rig comprising a raised drilling platform or work floor located proximate the drilling location. A blowout preventer (BOP) system comprises large, specialized valves or similar mechanical devices, used to seal, control and monitor fluid and/or gas wells. A blowout preventer manages extreme erratic pressures and uncontrolled fluids and/or gasses emanating from a well reservoir during drilling, which can lead to an event known as a blowout or kick. A blowout preventer system can include an assembly of several stacked blowout preventers of varying type and function, as well as auxiliary components. A typical blowout preventer system can include components such as electrical and hydraulic lines, control pods, hydraulic accumulators, test valves, kill and choke lines and valves, rams, valves, seals, riser joints, hydraulic connectors, and a support frame.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly, but is not intended to identify key features or essential features of the technology, nor is it intended to limit the scope of the claimed subject matter.

The present technology is directed to a system, apparatus, and method for controlling an electric choke actuator included in a drilling rig. In one example, a position of a well choke valve can be controlled using a computing device configured to monitor the position of a choke actuator coupled to the well choke valve and activate the choke actuator, causing the well choke valve to move to a new position, via user input, and provide position information for the well choke valve to the user.

Figure 1A:
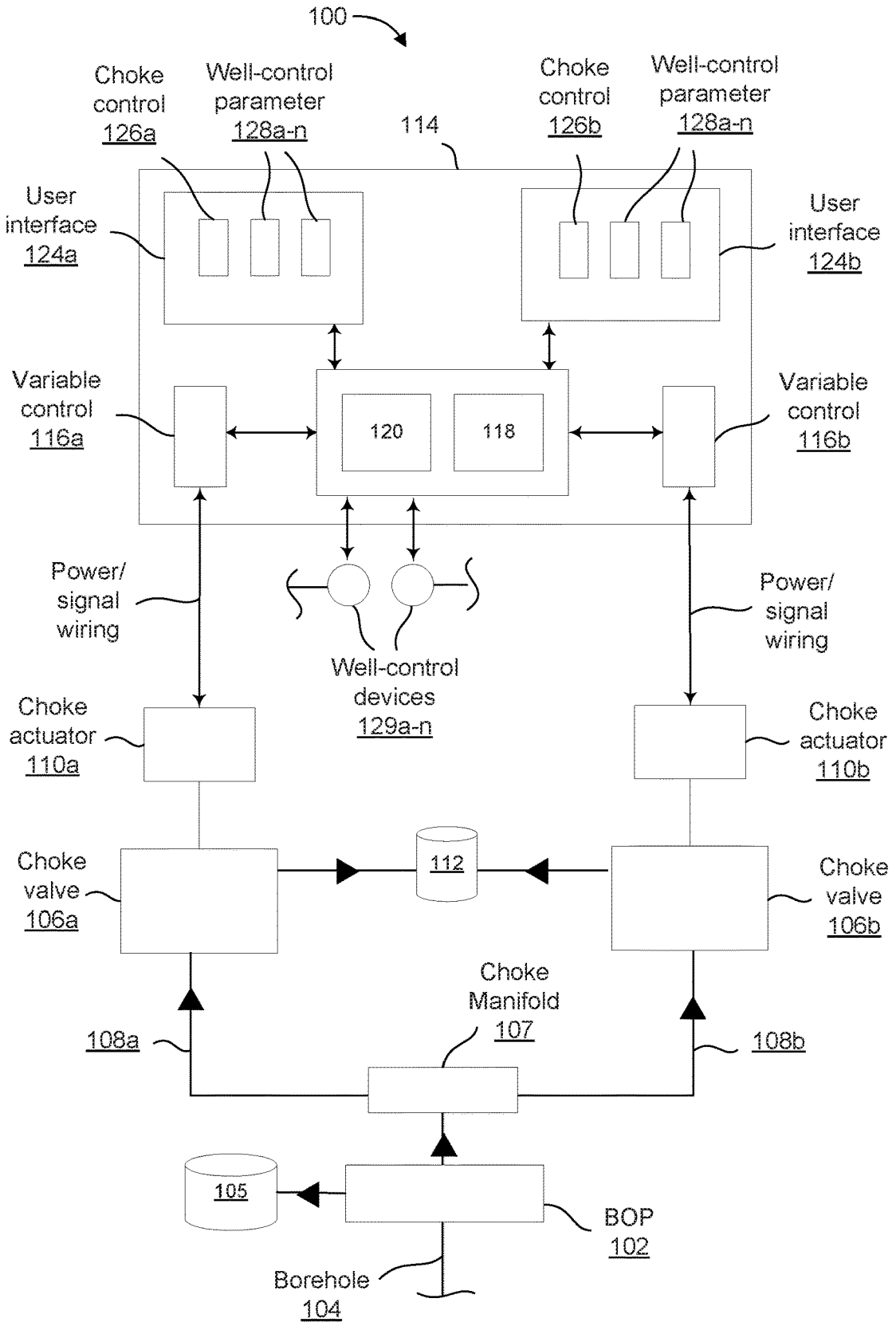
FIG. 1*a* is a block diagram that illustrates a drilling system in accordance with an example of the present disclosure.

To further describe the present technology, examples are now provided with reference to the figures. FIG. 1*a* shows a block diagram that schematically illustrates a drilling system 100 for facilitating extraction of subterranean natural resources, such as oil, gas, etc., in accordance with an example of the present disclosure. The drilling system 100 comprises a BOP (blow-out preventer) 102 fluidly coupled to a borehole 104 (e.g., via drill pipes/casings in the borehole) through which subterranean natural resources (e.g., oil and gas) are drawn from below the earth's surface with a drilling mechanism (not shown) coupled to the BOP 102. The drilling system 100 can be located on an onshore or offshore drilling rig. Normally, oil and/or gas are drawn through the borehole 104 and transferred to a main fluid reservoir 105 during normal operation, while the BOP 102 is open, in a typical manner. When undesirable pressures (i.e., pressures above a predetermined threshold or limit) are detected in the borehole 104 during drilling, the BOP 102 is closed (e.g., by a drilling operator) to prevent a "blow out." When closed, the BOP 102 diverts fluid (e.g., oil and/or gas) to one or more "chokes" (of a choke/kill manifold via choke lines)(typically one choke valve utilized at a time) to relieve pressure in the borehole 104, as currently practiced on drilling rigs. The chokes are controlled to maintain a particular fluid flow rate and fluid pressure through each respective choke. The chokes can be individually and selectively controlled until pressure is normalized about the borehole 104. Once pressure has been normalized in the borehole 104, the BOP 102 can be opened so that normal drilling operations can continue for drilling via the borehole 104.

In one example of the present disclosure, fluid and/or gas can be diverted by the BOP 102 (when closed) to a choke manifold 107 in a typical manner. The choke manifold 107 is configured to divert fluid to a first choke valve 106*a* via a first choke line 108*a*, and to a second choke valve 106*b* via a second choke line 108*b* (one or more choke valves may be used). A first electric choke actuator 110*a* can be operably coupled to the first choke valve 106*a* to control the position of the first choke valve 106*a* to regulate fluid flow (diverted by the BOP 102) through the first choke valve 106*a* to a surface fluid reservoir 112. Likewise, a second electric choke actuator 110*b* can be operably coupled to the second choke valve 106*b* to control and actuate the second choke valve 106*b* to regulate fluid flow (diverted by the BOP 102) through the second choke valve 106*b* to the surface fluid reservoir 112. Each of these choke actuators 110*a* and 110*b*, and associated choke valves 106*a* and 106*b*, can be individually and selectively controlled and activated (e.g., one choke actuator and choke valve can be operated independent of and while the other choke actuator and choke valve are caused to be inactive). Although not described here in detail, those skilled in the art will recognize that a variety of pipes, valves, and other mechanisms may existed between the reservoir 112 and the choke valves 106*a* and 106*b*, such as in a typical choke/kill manifold arrangement. The first choke valve 106*a* and the electric choke actuator 110*a* are commonly (and collectively) referred to as a "choke", which can comprise commercially available chokes, such as a "CAM30-DC multi-trim drilling choke" sold by Cameron corporation.

In one example, both first and second electric choke actuators 110*a* and 110*b* can be controlled from a drilling operator cabin 114 that structurally supports a variety of control components. For instance, first and second variable control devices 116*a* and 116*b* can be supported in the drilling operator cabin 114 and can each be communicatively coupled to respective first and second electric choke actuators 110*a* and 110*b* via wired or wireless connectivity (e.g., via Ethernet cables, wireless network components for signal transmission). The first and second variable control devices 116*a* and 116*b* can be variable frequency drives (VFDs) that are commercially available, such as any number of VFDs sold in the industry. Each variable control device 116*a* and 116*b* can be communicatively coupled to a motor control center 118 (MCC) supported in the drilling operator cabin 114 on a computing device, for example. The variable control devices can be variable frequency drives (VFDs) that are commercially available, such as ABB branded VFDs. Each variable control device 116*a* and 116*b* can be communicatively coupled to a motor control center 118 (MCC), as described in related U.S. patent application Ser. No. 15/475,042 filed Mar. 30, 2017, which is incorporated by reference herein in its entirety, or other suitable computing device 202 as described later. Various MCCs are commercially available for use on drilling rigs, such as those sold by Solids Control System corporation, or Siemens corporation. Thus, the variable control devices 116*a* and 116*b* can be coupled to respective choke actuators 110*a* and 110*b* via typical power and signal wiring, as noted on FIG. 1*a*.

The MCC 118 can comprise a robust set of drives, networks, servers, breakers, switches, and other electrical and mechanical components that may be used for a variety of purposes as pertaining to a drilling rig, such as for controlling site well rig, chokes, motors, mud pumps, mud circulation areas, oil tank areas, boiler rooms, logging power, blowout preventer and hydraulic station, and well site lighting and living power. Such components, systems, etc. supported by an MCC are known in the industry and are not discussed in detail herein. The computing device supporting the MCC 118 can comprise a CPU (Central Processing Unit) 120 having a processor, memory, drilling rig information modules, remote choke control modules, choke position control modules, etc., as described later.

The MCC 118 can be communicatively coupled (e.g., by Ethernet cables, or via wireless components for signal transmission) to first and second user interface devices 124*a* and 124*b* located in the drilling operator cabin 114, in one example. Each user interface device 124*a* and 124*b* can be configured to display rig data transmitted from the MCC 118 as gathered from various devices and mechanisms on the drilling rig. With the present technology, and as will be described in further detail below, the MCC 118 can receive, process, and transmit rig data that includes not only rig control data (as previously done), but now also choke position data. The choke position data can be associated with a position of the first and/or second electric choke actuators 110*a* and 110*b*, and the rig data can be associated with at least one well-control parameter 128*a-n*. In some examples, the at least one well-control parameter 128*a-n* can comprise at least one of well pressure information, mud pump information, fluid flow rate information, mast information, casing information, return percentage information, and other drilling rig information gathered from the systems, components, mechanisms, etc. on the drilling rig. Thus, the at least one well-control parameter 128*a-n* can be associated with at least one well-control device 129*a-n* of the drilling rig, such as devices and mechanisms that assist with drilling operations, such as mud pumps, various sensors (e.g., for fluid pressure and flow, casing and motor positions, etc.), drilling motors, hydraulic pumps, drill bits, turntables, etc. The at least one well-control device 129*a-n* can be coupled to the MCC 118 via suitable power and signal lines.

Such rig data can be received by the MCC 118 via a plurality of sensors associated with the drilling rig (further discussed herein), and then the rig data can be sent by the MCC 118 to each of first and second user interface devices 124*a* and 124*b* (or to a single user interface device). Each user interface device 124*a* and 124*b* can be configured to display data or information pertaining to the rig data. For example, the user interface 124*a* can include a graphical user interface that includes a choke valve control 126*a* (i.e., associated with choke actuator position data) and at least one well-control parameter 128*a-n* (i.e., associated with rig control data), as described with reference to FIG. 4. Note that FIG. 1*a* shows user interface devices 124*a* and 124*b* associated with respective variable control devices 116*a* and 116*b*, but a single user interface device can be provided for controlling both variable control devices 116*a* and 116*b*.

Figure 1B:
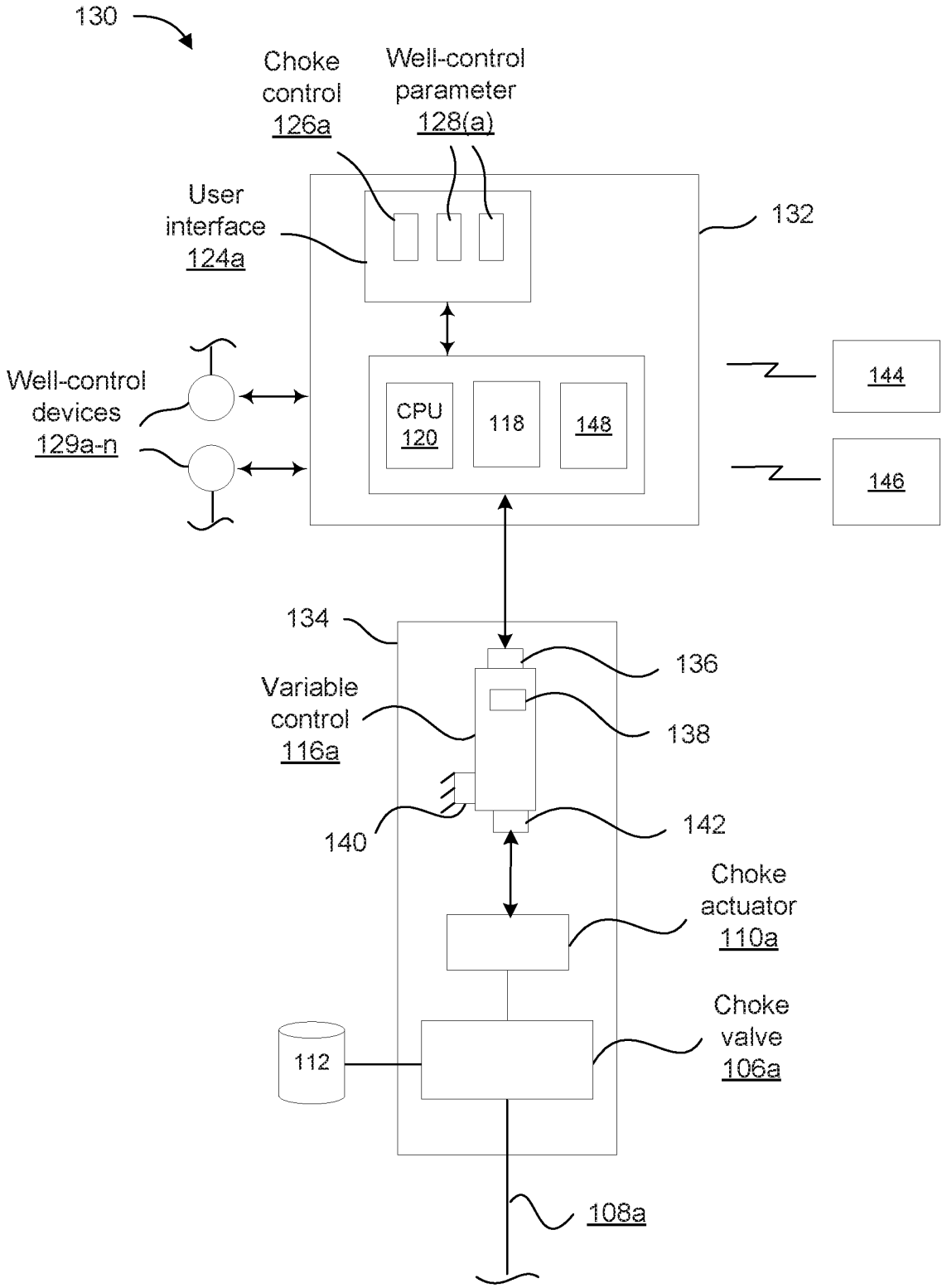
FIG. 1*b* is a block diagram that illustrates a drilling rig system and a choke system in accordance with an example of the present disclosure.

FIG. 1*b* is a block diagram that schematically illustrates a drilling rig 130 for facilitating extraction of subterranean natural resources in accordance with an example of the present disclosure. The drilling rig 130 comprises a drill rig control system 132 for controlling operations of the drilling rig 130 (which includes a variety of common drilling rig mechanisms, such as associated with the well-control parameters described herein). With cross-reference to FIG. 1*a*, the drill rig control system 132 comprising the user interface device 124*a* and the MCC 118 having the CPU 120. The drilling rig 130 further comprises a choke system 134 that can comprise the choke valve 106*a* associated with the blow-out preventer 102 of the drilling rig system 130.

The choke system 134 further comprises the electric choke actuator 110*a* that controls the choke valve 106, as described above. The choke system 134 further comprises the variable control device 116*a* for actuating the electric choke actuator 110*a*, as described above. Thus, the choke system 134 is integrated with the drill rig control system 132 to facilitate common control of the drilling rig 130 and the choke system 134 from the user interface device 124*a*.

In one example, the variable control device 116*a* comprises a motor control center interface 136 operable to communicatively couple the variable control device 116*a* to the motor control center 118 integrating the choke system 134 with the drill rig control system 132. The motor control center interface 136 can comprise a cable port for attaching a data cable (e.g., Ethernet line) between the variable control device 116*a* and the MCC 118. The variable control device 116*a* further comprises an electric choke actuator interface 140 communicatively coupling the variable control device 116*a* to the electric choke actuator 110*a* via a data cable (e.g., Ethernet line). Thus, the motor control center interface 136 communicatively couples the variable control device 116*a* to the user interface device 124*a* via the MCC 118. As a result, the user interface device 124*a* facilitates operator control of the variable control device 116*a* to actuate the electric choke actuator 110*a* to move the first choke valve 106*a* from a first position to a second position to regulate fluid flow, as further discussed above.

The choke system 134 can be designed using an open/closed circuit concept for initiating and stopping movement of the electric choke actuator 110*a*, where choke position is regulated by a 4-20 mA output that is calibrated and converted to a "percentage open" identifier on the user interface 124*a*, for instance, thereby monitoring movement and position of the choke valve 106*a*. The choke system 134 can be assigned one or more individual IP (Internet Protocol) addresses (e.g., each choke can comprise its own IP address). Specifically, each choke actuator 110*a* and 110*b* is assigned an individual IP address, which is how the MCC 118 (CPU) distinguishes between each choke actuator 110*a* and 110*b*. Control messages sent to the choke system 134 are routed to the choke system 134 using the IP address(es). The control messages instruct the choke system 134 to actuate the electric choke actuator 110*a* (similarly with the electric choke actuator 110*b*). Thus, in receiving a control message at the choke system 134, a control signal is generated that results in actuating the electric choke actuator 110*a*.

In one example, the variable control device 116*a* further comprises a user interface device 138 operable to facilitate manual control of the electric choke actuator 110*a*. The user interface device 138 can comprise controls for controlling a position of the choke valve 106*a*, and can display choke valve information. Therefore, the user interface device 138 can act as a backup or alternative control interface for the drilling operator.

In one example, the variable control device 116*a* comprises a driller cabin mount 142 configured to mount the variable control device 116*a* to a driller cabin (e.g., 114 of FIG. 1*a*). Thus, the variable control device 116*a* can be located near the driller operator within the driller cabin. This is a departure from existing systems that have a variable frequency device wired to an electric choke near the choke valve (i.e., distally away from the driller cabin). This is exacerbated by the fact that existing variable frequency devices are only communicatively coupled to their associated choke actuator, not to any computer system like an MCC 118. Thus, in existing systems during a potential blowout event, once the drill operator closes the BOP from the driller's cabin the operator is required to locate the variable frequency devices on the driller rig, and then manually operate the variable frequency devices to control positions of chokes. This is quite inefficient in terms of financial and safety considerations. Moreover, with such existing systems the operator may not be aware of the exact position of each choke valve, which can cause various undesirable fluid flow regulation issues. Thus, with the examples of the present disclosure, the drilling operator can view and monitor the position of choke valves (e.g., 106*a*, 106*b*) and at least one-well control parameter (e.g., 128*a-n*) all from a common user interface device (e.g., 124*a*, 124*b*). Further advantageously, the drilling operator can control operation of the choke actuators (e.g., 110*a*, 110*b*) from the driller cabin and via the user interface device because the entire system is now integrated (e.g., choke system 134 and drilling rig control system 132).

In one example, the MCC 118 comprises at least one wireless transmitter 148 for transmitting and receiving data signals to a remote computer system 146 and/or a remote well choke control 144 for controlling of the first electric choke actuator 110*a* (and any other choke actuator of the drilling rig). The transmitter(s) 148 can be located outside of the MCC 118 but communicatively coupled to the MCC 118 in a suitable matter.

In one aspect, the remote well choke control 144 is a wireless controller that the drilling operator can carry around a drilling rig for remotely controlling the first electric choke actuator 110*a* (and other chokes). The wireless controller can comprise command buttons for changing a position of the choke valve(s), and graphical displays for showing the position of the choke valve(s). Thus, control of the choke actuator 110*a* (via the MCC 118 and the variable control device 116*a*) is interchangeable between the user interface device 124*a* and the remote well choke control 144.

In one aspect, the remote computer system 146 is located remotely many miles from the drilling rig, such as at a central command center that remotely monitors various aspects of the drilling rig. Such communication can be transmitted via satellite between the MCC 118 and the remote computer system 146. Choke valves on existing drilling rigs are only controllable locally from the driller rig by a driller operator. In the present disclosure, the remote computer system 146 is configured to allow a remote user to remotely control the various choke actuators (e.g., 110*a* and 110*b*). Thus, control of the choke actuator 110*a* (via the MCC 118 and the variable control device 116*a*) is interchangeable between the user interface device 124*a* and the remote computer system 146. This is because of the seamless integration of the choke system 134 and the drill rig control system 132 of the drilling rig 130. In one aspect, the remote computer system 146 can override control of the choke system 134 from local control on the drilling rig.

Figure 2:
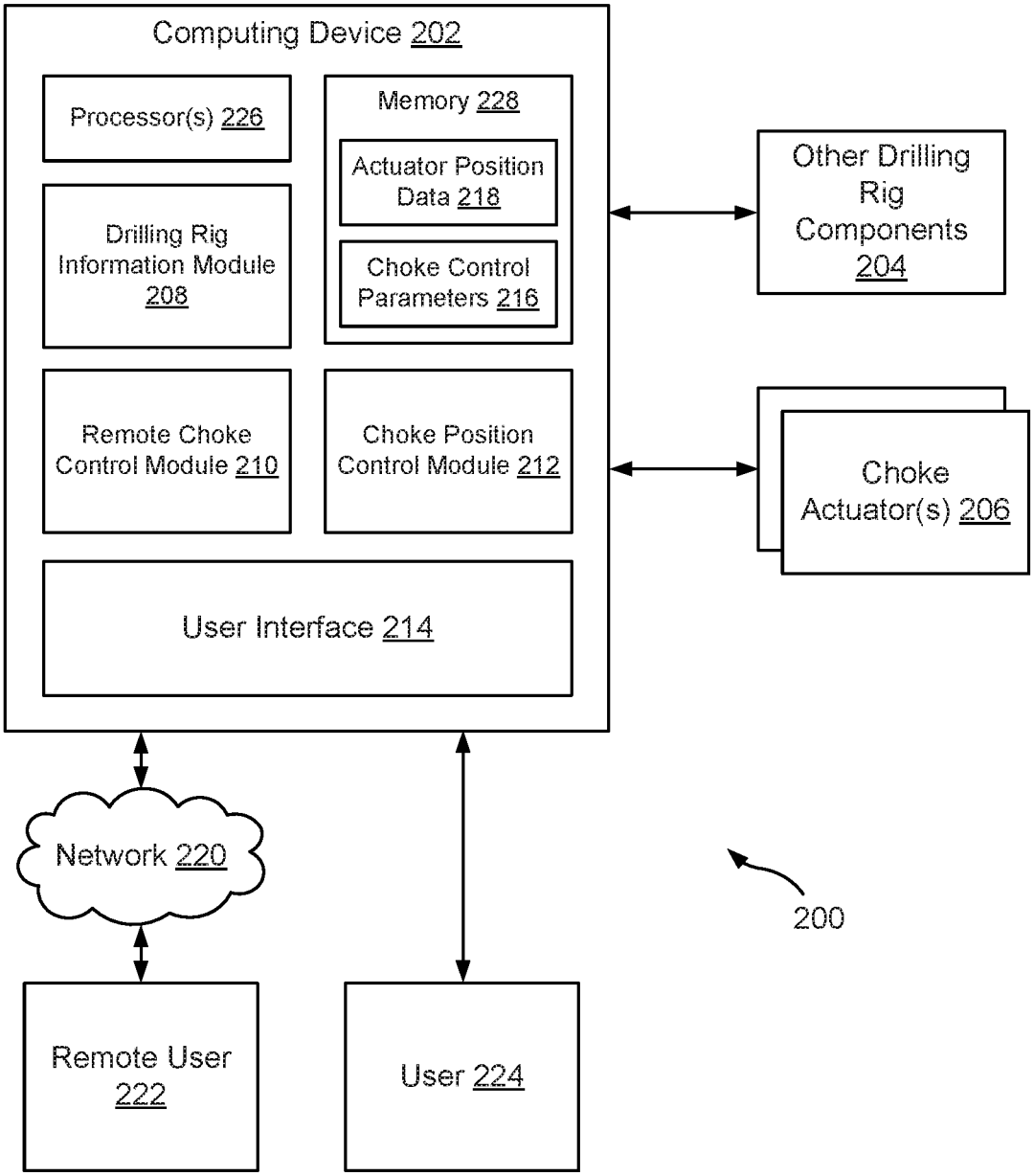
FIG. 2 is a block diagram illustrating a system for controlling an electric choke actuator included in a drilling rig in accordance with an example of the present disclosure.

FIG. 2 is a block diagram illustrating an example system 200 for controlling an electric choke actuator included in a drilling rig. The system 200 can include a computing device 202 that is coupled to one or more electric choke actuators 206. As described above, the computing device 202 may comprise, or may be included in, the MCC 118 shown in FIGS. 1*a-b*. The computing device 202 may be communicatively coupled to the electric choke actuator 206 via a digital control signal or an analog control signal. The computing device 202 may include modules configured to control an electric choke actuator 206 and obtain information associated with the electric choke actuator 206, as well as information associated with other drilling rig components 204.

As illustrated, the computing device 202 may include a choke position control module 212, a remote choke control module 210, and a drilling rig information module 208. A user interface 214 provides a user 224 or, a remote user 222, access to functionality of the modules 208/210/212, which is described in more detail below. The user interface 214 can include any type of user interface, including: a graphical user interface, a command line user interface, or a hardware user interface.

In one example, the choke position control module 212 can be configured to monitor a position of an electric choke actuator 206 and control the electric choke actuator 206 in response to user input. The choke position control module 212 monitors the position of the electric choke actuator 206 to determine the positional state of the well choke valve. That is, the position of the electric choke actuator 206 corresponds to a position of the well choke valve. Thus, the position of the electric choke actuator 206 can be used to determine whether the well choke valve is closed or to what degree or percentage that the well choke valve is open.

In monitoring the position of an electric choke actuator 206, the choke position control module 212 can store actuator position data 218 in memory 228. The actuator position data 218 may be for a current position of the electric choke actuator 206. The choke position control module 212 can provide the actuator position data 218 to the user interface 214 for the purpose of providing a user 224 or a remote user 222 with a current position of a well choke valve. One example of a user interface 214 is described in more detail later in association with FIG. 4.

A user 224 or a remote user 222 can control an electric choke actuator 206 via the user interface 214 to open and close a well choke valve. The user 224 or remote user 222 can use the user interface 214 to invoke a choke position command that is sent to the choke position control module 212. A choke position command instructs the choke position control module 212 to activate an electric choke actuator 206, opening or closing a well choke valve. The choke position control module 212 controls the well choke valve by activating the electric choke actuator 206, causing the choke valve to open or close as described in association with FIG. 1. For example, the choke position control module 212 can be instructed to activate the electric choke actuator 206 so that the well choke valve is fully open, fully closed, or partially open (e.g., 20%, 50%, or 90% open).

In receiving a choke position command via the user interface 214, the choke position control module 212 sends a control signal to an electric choke actuator 206 that causes the electric choke actuator 206 to move from a current position to a new position indicated by the choke position command. For example, a choke position command instructs the choke position control module 212 to move a well choke valve to a specified position (e.g., fully closed, fully open, or somewhere in-between). In receiving the choke position command, the choke position control module 212 determines the current position of the well choke valve by identifying the current position of an electric choke actuator 206, and then determines a direction and distance that the electric choke actuator 206 needs to move in order to move the well choke valve to the position specified in the choke position command. Next, the choke position control module 212 sends a control signal to the electric choke actuator 206 that causes the electric choke actuator 206 to move in the direction and distance determined by the choke position control module 212, thereby moving the well choke valve to the position specified in the choke position command.

In one example, the choke position control module 212 can be configured to execute a choke position command using choke control parameters 216. Choke control parameters 216 can include, but are not limited to: tuning parameters for setting a fully open position and a fully closed position, a tuning parameter for setting a maximum rate of the electric choke actuator, and a ramp speed parameter that indicates a rate of deceleration used to decelerate an electric choke actuator 206 as the electric choke actuator approaches a position specified in a choke position command.

In addition to providing actuator position data 218 for an electric choke actuator 206, the drilling rig information module 208 can be configured to obtain drilling rig data associated with other drilling rig components 204 and provide the drilling rig data to the user interface 214. Illustratively, the drilling rig data can include well pressure data, mud pump data, fluid flow rate data, mast data, casing data, return percentage data, as well as drilling rig data others drilling rig components included in a drilling rig. The drilling rig information module 208 can obtain drilling rig data for a drilling rig component 204 from the drilling rig component 204 or from another computing device that is communicatively coupled to the drilling rig component 204.

As mentioned above, the computing device 202 can include a remote choke control module 210 which can be configured to provide a remote user 222 with access to the computing device 202 for the purpose of controlling an electric choke actuator 206 coupled to the computing device 202, as described earlier. In one example, the computing device 202 can include a network interface controller (NIC) configured to receive a choke position command from a client device via a network 220 and provide the position data to the client device via the network 220.

As an example, using a client device, a remote user 222 can connect to the computing device 202 through the network 220. A client device used by a remote user 222 may include any device capable of sending and receiving data over a network 220. For example, a client device may comprise a processor-based device, such as a computing device that includes, but is not limited to: a desktop computer, laptop or notebook computer, tablet computer, mainframe computer system, handheld computer, workstation, network computer, or other computing devices with like capability. Illustratively, a client device may be located in a driller's cabin or in a remote location that is in network communication with the computing device 202.

The network 220 can include any useful computing network, including an intranet, the Internet, a local area network, a wide area network, a wireless data network, or any other such network or combination thereof. Components utilized for such a system may depend at least in part upon the type of network and/or environment selected. Communication over the network 220 may be enabled by wired or wireless connections and combinations thereof.

In connecting to the computing device 202, a remote user 222 may be presented with the computing device's user interface 214, providing the remote user 222 with position information for one or more electric choke actuators 206 coupled to the computing device 202. As described above, in some examples drilling rig data for other drilling rig components 204 can be provided to the user interface 214, allowing a remote user 222 to monitor the other drilling rig components 204 via the user interface 214. A remote user 222 can remotely control a position of an electric choke actuator 206 using the user interface 214. For example, the remote user 222 can use the user interface 214 to invoke a choke position command that is sent to the choke position control module 212, whereupon the choke position module 212 executes the choke position command. The choke position module 212 can then provide updated actuator position data 218 to the user interface 214, thereby providing notice to the remote user 222 that the choke position command was executed.

The various processes and/or other functionality contained within the computing device 202 may be executed on one or more processors 226 that are in communication with one or more memory modules 228 and/or data stores. The term "data store" may refer to any device or combination of devices capable of storing, accessing, organizing and/or retrieving data. Storage system components of a data store may include storage systems such as a SAN (Storage Area Network), cloud storage network, volatile or non-volatile RAM, optical media, or hard-drive type media. The data store may be representative of a plurality of data stores as can be appreciated. While FIG. 2 illustrates an example of a system 200 that may implement the techniques above, many other similar or different environments are possible. The example environments discussed and illustrated above are merely representative and not limiting.

Figure 3:
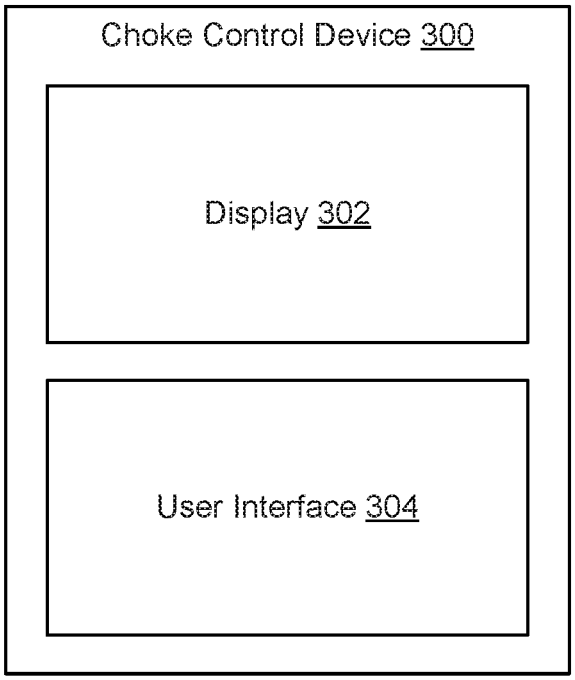
FIG. 3 is a block diagram that illustrates a choke control device configured to control the position of one or more electric choke actuators in accordance with an example of the present disclosure.

FIG. 3 is a block diagram that illustrates an example choke control device 300 configured to control the position of one or more electric choke actuators. The choke control device 300 comprises a computing device that can include at least some of the components described above in association with FIG. 2. As illustrated, the choke control device 300 can include a user interface 304 and a display 302.

The user interface 304 may comprise interface controls (e.g., hardware interface buttons and/or software interface buttons) that are used to navigate choke control menus, functions, information, and input choke position commands for controlling the electric choke actuator 206 referenced in FIG. 2. The display 302 may be configured to display the choke control menus, functions, and information that are navigated using the user interface 304.

Illustratively, the choke control device 300 can be used to: configure a variable frequency device (VFD) configured to activate an electric choke actuator, control the electric choke actuator to open and close a well choke valve, and switch between local control of the VFD and remote control of the VFD. For example, the choke control device 300 can be used to initialize the system as described later in association with FIG. 5. Thereafter, the choke control device 300 can be used to operate the electric choke actuator locally, or switch over to remote control enabling the choke control device 300 to be controlled by a client device located in a driller's cabin, or another remote client device. In one example, the user interface 304 of the choke control device 300 can include a lock control (e.g., a lock interface button) that locks the user interface of the choke control device 300 while the electric choke actuator is being remotely controlled. This can provide a safety interlocking feature for a drilling rig that prevents unwanted rig operations while well control operations are underway. That is, another drilling operator is prevented from modifying a choke position because choke control is managed from the drilling operator cabin by the drilling operator.

Figure 4:
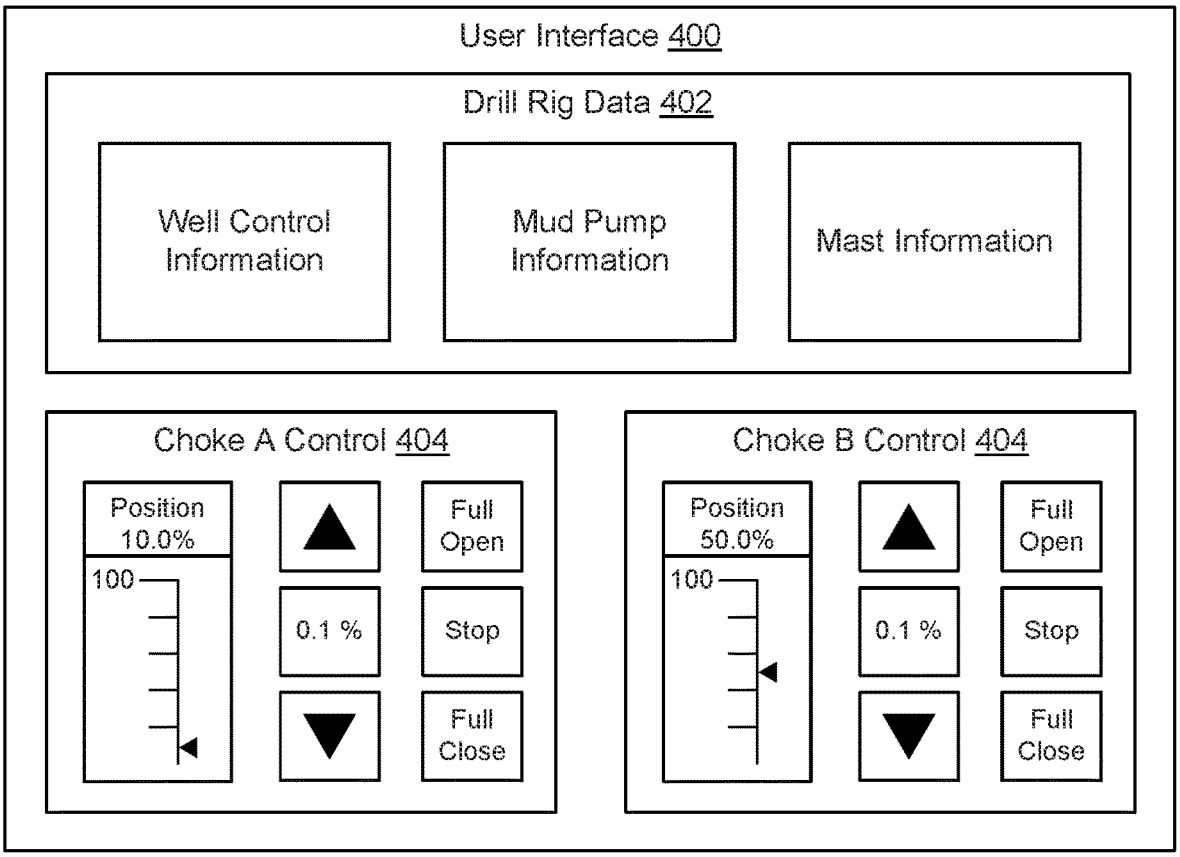
FIG. 4 is a diagram illustrating a choke control user interface in accordance with an example of the present disclosure.

FIG. 4 is a diagram illustrating an example user interface 400. In one example, the user interface 400 can be provided to a client device that is remotely connected to the choke control device described above. For example, the user interface 400 can be provided by the choke control device to a browser application over a network connection, or the user interface 400 can be installed on a client device that is in network communication with the choke control device.

As shown, the user interface 400 can include a graphical user interface that includes one or more choke controls 404, and in some examples, drill rig data 402. Input devices, including a touch screen, can be used to interact with a choke control 404 and drill rig data 402 included in the user interface 400. The choke control 404 can be used to activate an electric choke actuator using the input controls of the choke control 404. For example, a user can open and close a well choke valve by selecting a respective input control of the choke control 404, thereby activating the electric choke actuator and causing the well choke valve to move to a specified position.

Figure 5:
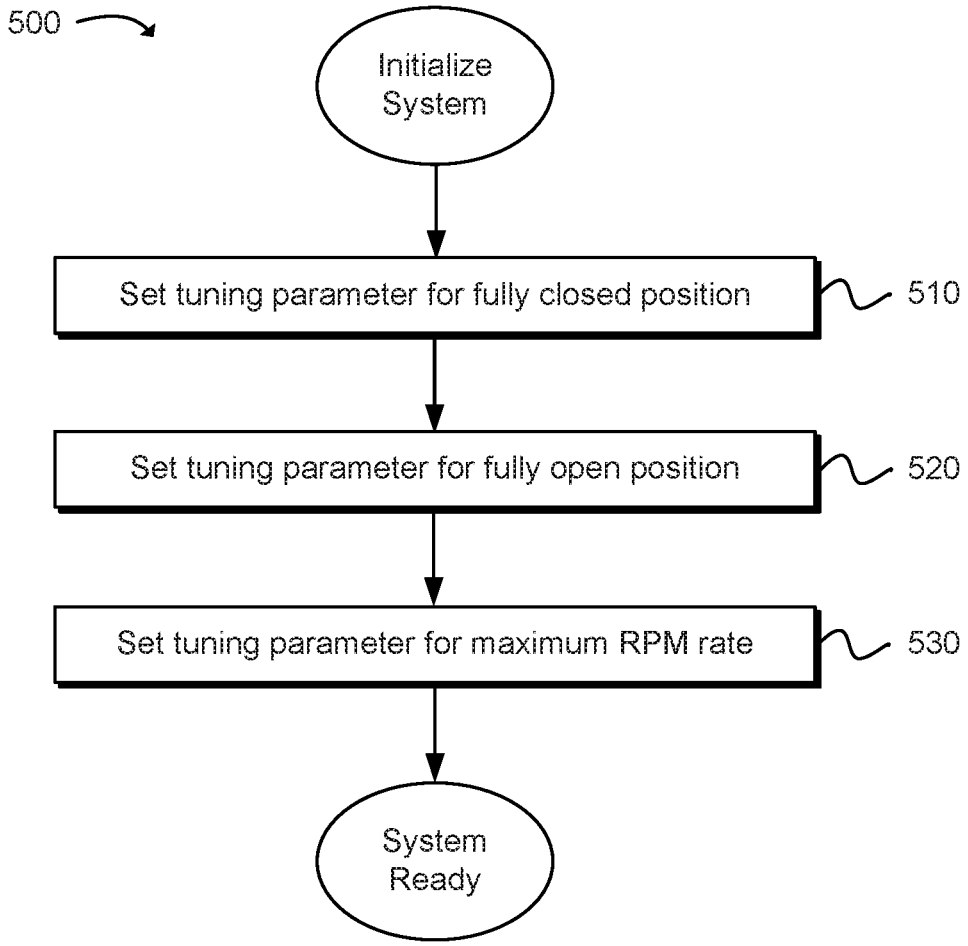
FIG. 5 is a flow diagram that illustrates a method for initializing a choke control system in accordance with an example of the present disclosure.

FIG. 5 is a flow diagram that illustrates an example method 500 for initializing the choke control system described above. The choke control system can be initialized by setting choke control parameters used to control the position of a well choke valve. More specifically, the choke control parameters can be set to configure a VFD to activate an electric choke actuator that opens and closes the well choke valve.

The choke control parameters may include tuning parameters used to set a fully closed position and a fully open position of the electric choke actuator. That is, the tuning parameters are used to configure the VFD to activate the electric choke actuator to a fully closed position and a fully open position. As in block 510, a value of a tuning parameter for a fully closed position of the electric choke actuator can be set. In one example, the value of the tuning parameter can be set by selecting the tuning parameter (e.g., via the user interface of the choke control device shown in FIG. 3) and activating the electric choke actuator to a full closed position and validating that a potentiometer is lined up with a fully closed position indicator on the electric choke actuator. After verifying that the electric choke actuator is in the fully closed position, the value of the tuning parameter can be set to fully closed.

As in block 520, a value of a tuning parameter for a fully open position of the electric choke actuator can be set. In one example, the value of the tuning parameter can be set by selecting the tuning parameter and activating the electric choke actuator to a fully open position and setting the value of the tuning parameter to fully open.

As in block 530, a value of a tuning parameter for a maximum RPM (Rotations Per Minute) rate can be set. The maximum RPM rate controls a rate at which the electric choke actuator operates to open and close the well choke valve. In one example, the value of the tuning parameter can be set by selecting the tuning parameter and setting the value of the tuning parameter to the desired RPM rate. As will be appreciated, the choke control system may include additional tuning parameters, as well as other parameters that can be initialized. The method 500 merely illustrates one example of initializing a choke control system and is not meant in any way to be limiting.

Figure 6:
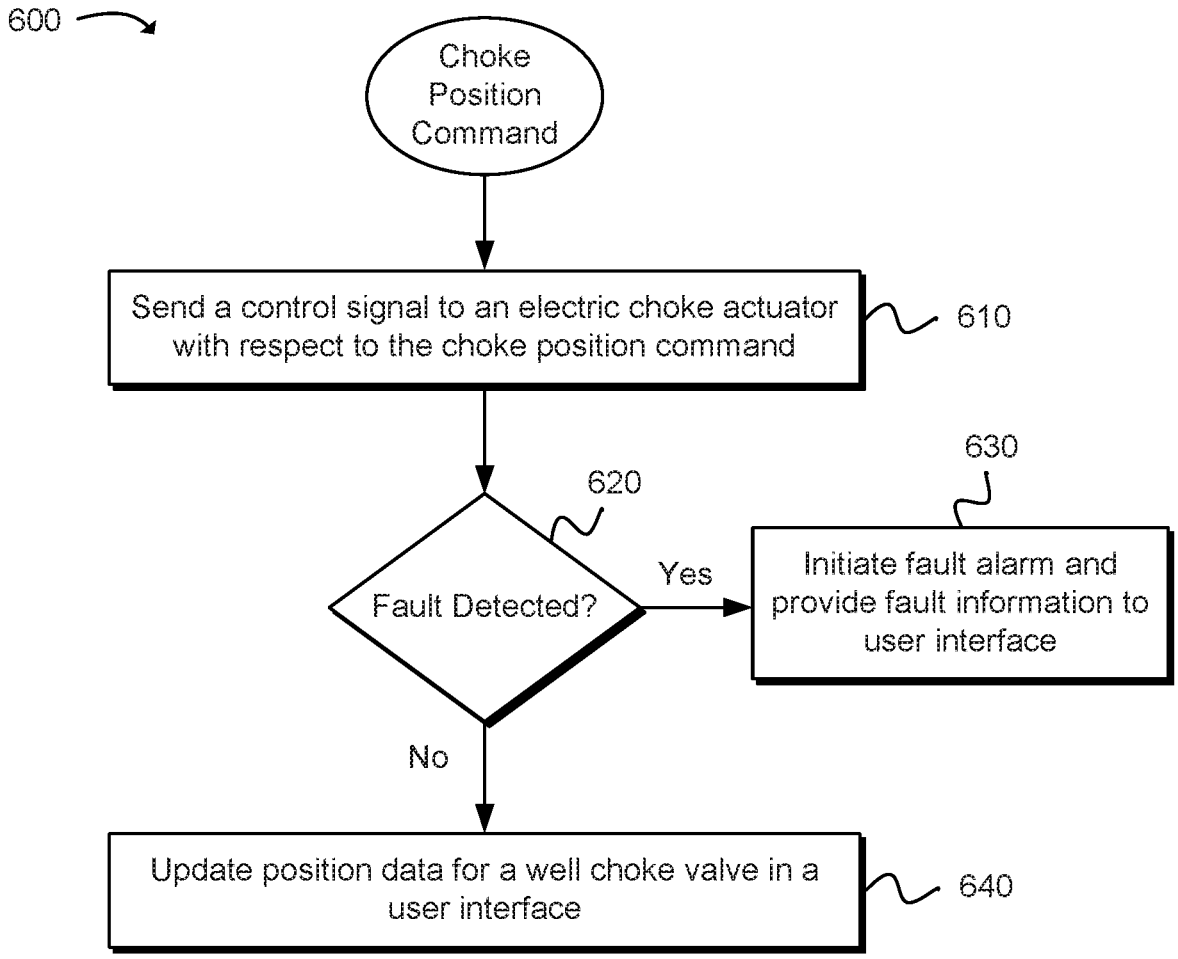
FIG. 6 is a flow diagram illustrating a method for executing a choke position command in accordance with an example of the present disclosure.

FIG. 6 is a flow diagram illustrating an example method 600 for executing a choke position command invoked by a user. As in block 610, in response to receiving the choke position command, a choke control device sends a control signal to an electric choke actuator. In sending the control signal, the choke control device may be configured to detect warnings and faults that may occur during (or prior to) execution of the choke position command. A warning may be associated with a non-critical condition of the choke control system and may not prevent normal operation of the system. A fault indicates a condition that prevents the system from operating normally. For example, a communication fault may prevent the system from operating due to a break in a communication channel between components (e.g., an unplugged Ethernet cable).

As in block 620, in the case that the choke control device detects a fault, the choke control device initiates a fault alarm and provides fault information to a user interface, as shown in block 630. For example, in the case that a communication channel fault is detected, a communication channel fault alarm is initiated and information for the communication channel fault alarm is displayed in the user interface.

In the case that no fault is detected, the control signal results in moving the electric choke actuator to the position specified in the choke position command, thereby causing a well choke valve to open or close. As in block 640, position data for the well choke valve is updated in a user interface, indicating the current position of the well choke valve to the user. In one example, the position data can be updated in the user interface in parallel to activating the electric choke actuator, thereby providing a user with a position of the well choke valve during movement of the electric choke actuator. In another example, the position data can be updated in the user interface after moving the electric choke actuator from a first position to a second position.

Figure 7:
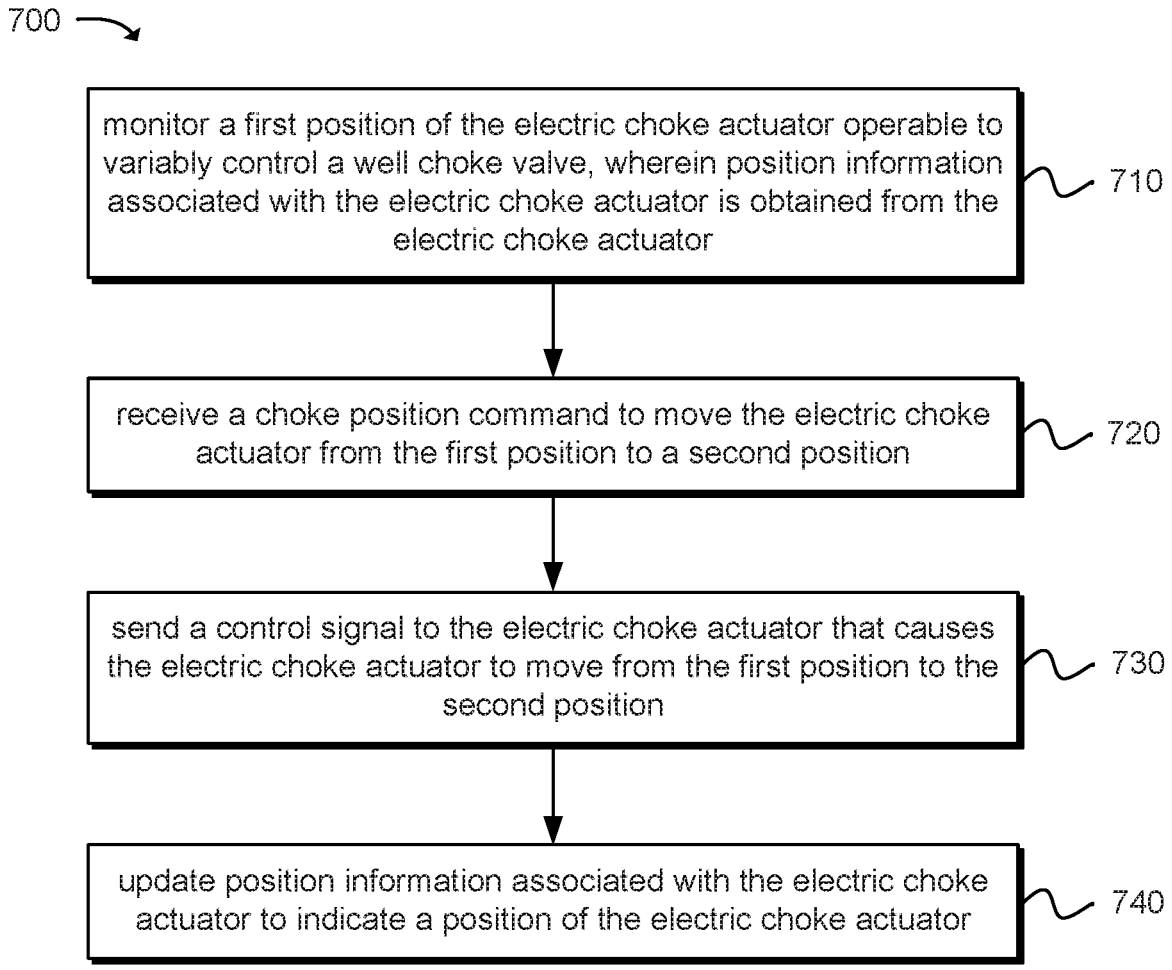
FIG. 7 is a flow diagram that illustrates a method for controlling an electric choke actuator included in a drilling rig in accordance with an example of the present disclosure.

FIG. 7 is a flow diagram that illustrates an example method 700 for controlling an electric choke actuator included in a drilling rig. As in block 710, a first position of the electric choke actuator can be monitored. The electric choke actuator being operable to variably control a well choke valve, wherein position information associated with the electric choke actuator can be obtained from the electric choke actuator.

As in block 720, a choke position command is received. The choke position command may be an instruction to move the electric choke actuator from the first position to a second position. In one example, a user interface may be configured to receive a choke position command input, as well as show position data for the position of the electric choke actuator.

In response to receiving the choke position command, as in block 730, a control signal is sent to the electric choke actuator that causes the electric choke actuator to move from the first position to the second position. As in block 740, position information associated with the electric choke actuator can be updated to indicate a position of the electric choke actuator. For example, position information can be provided to a user interface that allows a user to monitor movement of the well choke valve that results from movement of the electric choke actuator. In addition to controlling a first electric choke actuator, the method 700 can be used to control a second electric choke actuator included in the drilling rig.

Figure 8:
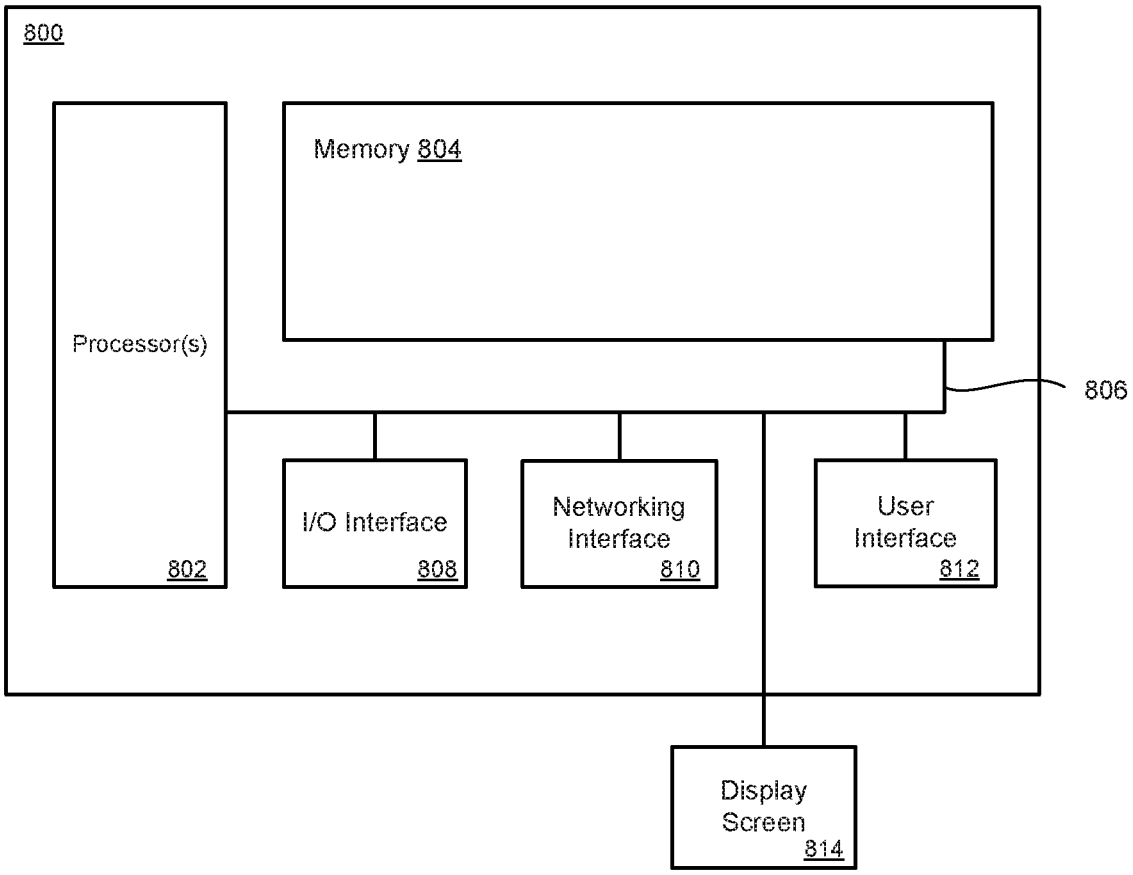
FIG. 8 is block diagram illustrating a computing device that may be used in a system for controlling an electric choke actuator in accordance with an example of the present disclosure.

FIG. 8 illustrates a computing device 800 on which modules of this technology may execute. The computing device 800 is illustrated on which a high-level example of the technology may be executed. The computing device 800 may include one or more processors 802 that are in communication with memory devices 804. The computing device 800 may include a local communication interface 806 for the components in the computing device 800. For example, the local communication interface 806 may be a local data bus and/or any related address or control busses as may be desired.

The memory device 804 may contain modules that are executable by the processor(s) 802 and data for the modules. For example, the memory device 804 may include a choke position control module, remote choke control module, a drilling rig information module, and other modules. The modules may execute the functions described earlier. A data store may also be located in the memory device 804 for storing data related to the modules and other applications along with an operating system that is executable by the processor(s) 802.

Other applications may also be stored in the memory device 804 and may be executable by the processor(s) 802. Components or modules discussed in this description that may be implemented in the form of software using high programming level languages that are compiled, interpreted, or executed using a hybrid of methods.

The computing device 800 may also have an I/O (input/output) interface 808 used to communicate with I/O devices. One example of an I/O device is a display screen 814. The computing device 800 may include a networking interface 810 used receive and send network communications. The networking interface 810 may be a wired or wireless networking device that connects to the internet, a LAN, WAN, or other computing networks.

Components or modules stored in the memory device 804 may be executed by the processor(s) 802. The term "executable" may mean a program file that is in a form that may be executed by a processor 802. For example, a program in a higher level language may be compiled into machine code in a format that may be loaded into a random access portion of the memory device 804 and executed by the processor 802, or source code may be loaded by another executable program and interpreted to generate instructions in a random access portion of the memory device 804 to be executed by a processor 802. The executable program may be stored in any portion or component of the memory device 804. For example, the memory device 804 may be random access memory (RAM), read only memory (ROM), flash memory, a solid state drive, memory card, a hard drive, optical disk, floppy disk, magnetic tape, or any other memory components.

The processor 802 may represent multiple processors and the memory device 804 may represent multiple memory units that operate in parallel to the processing circuits. This may provide parallel processing channels for the processes and data in the system. The local interface 806 may be used as a network to facilitate communication between any of the multiple processors 802 and multiple memories 804. The local interface 806 may use additional systems designed for coordinating communication such as load balancing, bulk data transfer and similar systems.

While the flowcharts presented for this technology may imply a specific order of execution, the order of execution may differ from what is illustrated. For example, the order of two more blocks may be rearranged relative to the order shown. Further, two or more blocks shown in succession may be executed in parallel or with partial parallelization. In some configurations, one or more blocks shown in the flow chart may be omitted or skipped. Any number of counters, state variables, warning semaphores, or messages might be added to the logical flow for purposes of enhanced utility, accounting, performance, measurement, troubleshooting or for similar reasons.

Some of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more blocks of computer instructions, which may be organized as an object, procedure, or function. Nevertheless, the executables of an identified module need not be physically located together, but may comprise disparate instructions stored in different locations which comprise the module and achieve the stated purpose for the module when joined logically together.

Indeed, a module of executable code may be a single instruction, or many instructions and may even be distributed over several different code segments, among different programs and across several memory devices. Similarly, operational data may be identified and illustrated herein within modules and may be embodied in any suitable form and organized within any suitable type of data structure. The operational data may be collected as a single data set, or may be distributed over different locations including over different storage devices. The modules may be passive or active, including agents operable to perform desired functions.

The technology described here may also be stored on a computer readable storage medium that includes volatile and non-volatile, removable and non-removable media implemented with any technology for the storage of information such as computer readable instructions, data structures, program modules, or other data. Computer readable storage media include, but is not limited to, non-transitory media such as RAM, ROM, EEPROM, flash memory or other memory technology, CD-ROM, digital versatile disks (DVD) or other optical storage, magnetic cassettes, magnetic tapes, magnetic disk storage or other magnetic storage devices, or any other computer storage medium which may be used to store the desired information and described technology.

The devices described herein may also contain communication connections or networking apparatus and networking connections that allow the devices to communicate with other devices. Communication connections are an example of communication media. Communication media typically embodies computer readable instructions, data structures, program modules and other data in a modulated data signal such as a carrier wave or other transport mechanism and includes any information delivery media. A "modulated data signal" means a signal that has one or more of its characteristics set or changed in such a manner as to encode information in the signal. By way of example and not limitation, communication media includes wired media such as a wired network or direct-wired connection and wireless media such as acoustic, radio frequency, infrared and other wireless media. The term computer readable media as used herein includes communication media.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A system for controlling an electric choke actuator included in a drilling rig, comprising:

at least one processor;

a memory device including instructions that, when executed by the at least one processor, cause the system to:

provide, via a network to a client device, position data for the electric choke actuator configured to control a well choke valve in selective fluid communication with a blow-out preventer arranged to close a borehole;

receive, via the network from the client device, a choke position command to move the electric choke actuator from a first position to a second position;

send a control signal to the electric choke actuator that causes the electric choke actuator to move from the first position to the second position as specified by the choke position command, wherein a ramp speed parameter indicates a rate of deceleration to use to decelerate the electric choke actuator when approaching the second position; and provide, via the network to the client device, updated position data for the second position of the electric choke actuator.

2. The system of claim 1, wherein the position data is obtained from the electric choke actuator.

3. The system of claim 1, wherein the system is communicatively coupled to the electric choke actuator via a digital control signal or an analog control signal.

4. The system of claim 1, further comprising a user interface configured to receive choke position command input.

5. The system of claim 4, wherein the user interface is further configured to show the position data for the position of the electric choke actuator.

6. The system of claim 1, wherein the memory device includes instructions that, when executed by the processor, cause the system to receive drilling rig data from other drilling components included in the drilling rig.

7. The system of claim 6, wherein the drilling rig data for the other drilling components included in the drilling rig include: mud pump data, well control data, or mast data.

8. The system of claim 6, wherein the drilling rig data is provided to a user interface configured to show the drilling rig data in combination with the position data for the position of the electric choke actuator.

9. The system of claim 1, further comprising a network interface controller configured to receive the choke position command from the client device via the network and provide the position data to the client device via the network.

10. A well choke control apparatus, comprising:

a processor;

a memory device for storing choke control parameters;

a display for showing well choke information; and circuitry configured to:

provide, via a network to a client device, position data for a first position of an electric choke actuator operable to control a well choke valve;

receive, via the network from the client device, a choke position command to move the electric choke actuator from the first position to a second position;

send a control signal to the electric choke actuator that causes the electric choke actuator to move to the second position based in part on the choke control parameters, wherein the choke control parameters include a ramp speed parameter that indicates a rate of deceleration to use to decelerate the electric choke actuator when approaching the second position; and provide, via the network to the client device, updated position data for the second position to the display.

11. The well choke control apparatus of claim 10, the circuitry being further configured to receive values for the choke control parameters via a user interface.

12. The well choke control apparatus of claim 11, wherein the choke control parameters include tuning parameters for setting a fully open position and a fully closed position.

13. The well choke control apparatus of claim 11, wherein the choke control parameters include a tuning parameter for setting a maximum rate of the electric choke actuator.

14. The well choke control apparatus of claim 10, further comprising a remote well choke control configured to interchange control of the electric choke actuator between the well choke control apparatus and a remote computing device.

15. The well choke control apparatus of claim 14, wherein the remote well choke control is further configured to lock a user interface of the well choke control apparatus while the electric choke actuator is being remote controlled.

16. A computer implemented method for controlling an electric choke actuator included in a drilling rig, comprising:

monitoring a first position of the electric choke actuator operable to variably control a well choke valve, wherein position information associated with the electric choke actuator is obtained from the electric choke actuator;

receiving, via a network from a client device, a choke position command to move the electric choke actuator from the first position to a second position;

sending a control signal to the electric choke actuator that causes the electric choke actuator to move from the first position to the second position, wherein a ramp speed parameter indicates a rate of deceleration to use to decelerate the electric choke actuator when approaching the second position; and updating position information associated with the electric choke actuator to indicate a position of the electric choke actuator.

17. The computer implemented method of claim 16, further comprising controlling a second electric choke actuator that is included in the drilling rig.

18. The computer implemented method of claim 16, further comprising detecting a fault associated with performing the choke position command.

19. The computer implemented method of claim 18, further comprising initiating a fault alarm and providing fault information to a user interface.

* * * * *